US006397865B1

(12) United States Patent
Wilson et al.

(10) Patent No.: US 6,397,865 B1
(45) Date of Patent: Jun. 4, 2002

(54) TIE-DOWNS FOR A TABLE UMBRELLA

(76) Inventors: Lillian G. Wilson; Arthur H. Wilson, both of 28019 Robin Ave., Saugus, CA (US) 91350

( * ) Notice: Subject to any disclaimer, the term of this patent is extended or adjusted under 35 U.S.C. 154(b) by 0 days.

(21) Appl. No.: 09/502,301

(22) Filed: Feb. 11, 2000

(51) Int. Cl.[7] ..... A45B 3/00

(52) U.S. Cl. ..... 135/16; 135/98; 135/99; 24/298; 24/302; 24/372

(58) Field of Search ..... 24/68 CD, 298–302, 24/370, 372, 376, 499, 500, 129 R, 131 R; 248/499, 500; 135/16, 98, 99

(56) References Cited

U.S. PATENT DOCUMENTS

| | | | | | |
|---|---|---|---|---|---|
| 1,549,262 | A | * | 8/1925 | Johnston, Jr. | 24/584 |
| 2,325,645 | A | * | 8/1943 | White | 135/98 |
| 2,531,836 | A | * | 11/1950 | Barr | 135/98 X |
| 2,847,019 | A | * | 8/1958 | Ogle, Sr. | 114/361 |
| 3,279,663 | A | | 10/1966 | Torres | |
| 3,407,825 | A | * | 10/1968 | Doyle | 135/16 |
| 3,610,684 | A | * | 10/1971 | Richter | 296/152 |
| 3,704,489 | A | * | 12/1972 | Rudd | 24/122.3 |
| 3,971,589 | A | | 7/1976 | Elrod | |
| 4,040,545 | A | * | 8/1977 | Hill | 223/85 |
| 4,155,537 | A | | 5/1979 | Bronson et al. | |
| 4,188,061 | A | | 2/1980 | Shehi | |
| 4,285,354 | A | * | 8/1981 | Beavers | 135/16 |
| 4,549,411 | A | * | 10/1985 | Ivey | 63/2 |
| D287,099 | S | | 12/1986 | Cory | |
| 4,769,875 | A | * | 9/1988 | Hartman | 24/300 |
| 5,025,819 | A | | 6/1991 | Taylor | |
| 5,035,558 | A | * | 7/1991 | Prosen | 410/96 |
| 5,150,728 | A | * | 9/1992 | Stark | 135/16 |
| 5,351,367 | A | * | 10/1994 | Kennedy et al. | 24/129 R |
| 5,441,066 | A | * | 8/1995 | Harris | 135/98 X |
| 5,472,101 | A | * | 12/1995 | Ahrens | 211/70.5 |
| 5,921,259 | A | * | 7/1999 | Ehler | 135/88.15 |
| 6,264,583 | B1 | * | 7/2001 | Rich | 482/27 |
| 6,317,935 | B1 | * | 11/2001 | O'Rouke | 24/129 R |
| 6,332,471 | B1 | * | 12/2001 | Lai | 135/16 |

* cited by examiner

*Primary Examiner*—Anthony Knight
*Assistant Examiner*—Ruth C. Rodriguez

(57) ABSTRACT

A tie-downs for a table umbrella for preventing damage to a table umbrella. The tie-downs for a table umbrella include a plurality of rigid elongate members which are essentially made of stiff wire with each having a first hook-like end and a second hook-like end both of which are adapted to attach to a table and an umbrella; and also includes a plurality of coupling members each of which is essentially a flat, rigid strip-like piece having a plurality of holes spaced therealong for coupling a respective pair of elongate members one of which is attached to the table and the other of which is attached to the umbrella.

7 Claims, 2 Drawing Sheets

TIE-DOWNS FOR A TABLE UMBRELLA

BACKGROUND OF THE INVENTION

1. Field of the Invention

The present invention relates to umbrella anchor and more particularly pertains to new tie-downs for a table umbrella for preventing damage to a table umbrella.

2. Description of the Prior Art

The use of umbrella anchor is known in the prior art. More specifically, umbrella anchor heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,279,663; 4,155,537; 4,188,061; 5,025,819; 3,971,589; and U.S. Pat. No. Des. 287,099.

While these devices fulfill their respective, particular objectives and requirements, the aforementioned patents do not disclose new tie-downs for a table umbrella. The inventive device includes a plurality of rigid elongate members which are essentially made of stiff wire with each having a first hook-like end and a second hook-like end both of which are adapted to attach to a table and an umbrella; and also includes a plurality of coupling members each of which is essentially a flat, rigid strip-like piece having a plurality of holes spaced therealong for coupling a respective pair of elongate members one of which is attached to the table and the other of which is attached to the umbrella.

In these respects, the tie-downs for a table umbrella according to the present invention substantially departs from the conventional concepts and designs of the prior art, and in so doing provides an apparatus primarily developed for the purpose of preventing damage to a table umbrella.

SUMMARY OF THE INVENTION

In view of the foregoing disadvantages inherent in the known types of umbrella anchor now present in the prior art, the present invention provides a new tie-downs for a table umbrella construction wherein the same can be utilized for preventing damage to a table umbrella.

The general purpose of the present invention, which will be described subsequently in greater detail, is to provide a new tie-downs for a table umbrella which has many of the advantages of the umbrella anchor mentioned heretofore and many novel features that result in new tie-downs for a table umbrella which is not anticipated, rendered obvious, suggested, or even implied by any of the prior art umbrella anchor, either alone or in any combination thereof.

To attain this, the present invention generally comprises a plurality of rigid elongate members which are essentially made of stiff wire with each having a first hook-like end and a second hook-like end both of which are adapted to attach to a table and an umbrella; and also includes a plurality of coupling members each of which is essentially a flat, rigid strip-like piece having a plurality of holes spaced therealong for coupling a respective pair of elongate members one of which is attached to the table and the other of which is attached to the umbrella.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new tie-downs for a table umbrella which has many of the advantages of the umbrella anchor mentioned heretofore and many novel features that result in new tie-downs for a table umbrella which is not anticipated, rendered obvious, suggested, or even implied by any of the prior art umbrella anchor, either alone or in any combination thereof.

It is another object of the present invention to provide new tie-downs for a table umbrella which may be easily and efficiently manufactured and marketed.

It is a further object of the present invention to provide new tie-downs for a table umbrella which is of a durable and reliable construction.

An even further object of the present invention is to provide a new tie-downs for a table umbrella which is susceptible of a low cost of manufacture with regard to both materials and labor, and which accordingly is then susceptible of low prices of sale to the consuming public, thereby making such tie-downs for a table umbrella economically available to the buying public.

Still yet another object of the present invention is to provide a new tie-downs for a table umbrella which provides in the apparatuses and methods of the prior art some of the advantages thereof, while simultaneously overcoming some of the disadvantages normally associated therewith.

Still another object of the present invention is to provide new tie-downs for a table umbrella for preventing damage to a table umbrella.

Yet another object of the present invention is to provide new tie-downs for a table umbrella which includes a plurality of rigid elongate members which are essentially made of stiff wire with each having a first hook-like end and a second hook-like end both of which are adapted to attach to a table and an umbrella; and also includes a plurality of coupling members each of which is essentially a flat, rigid strip-like piece having a plurality of holes spaced therealong for coupling a respective pair of elongate members one of which is attached to the table and the other of which is attached to the umbrella.

Still yet another object of the present invention is to provide new tie-downs for a table umbrella that securely anchors the umbrella to the table especially during high winds.

Even still another object of the present invention is to provide new tie-downs for a table umbrella that keeps the umbrella from making a racket during high winds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
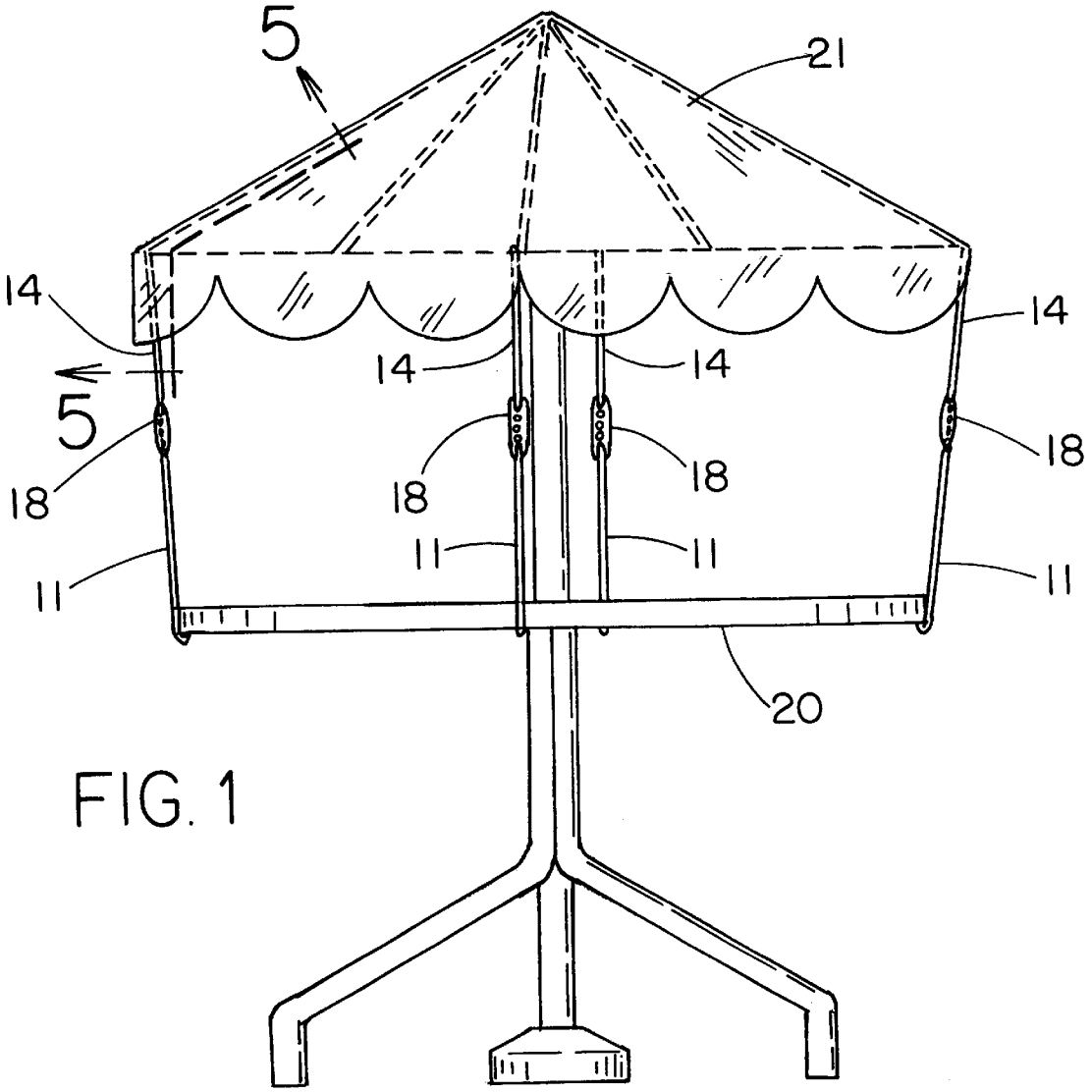
FIG. 1 is a side elevational view of a new tie-downs for a table umbrella according to the present invention and being put to use.
Figure 2:
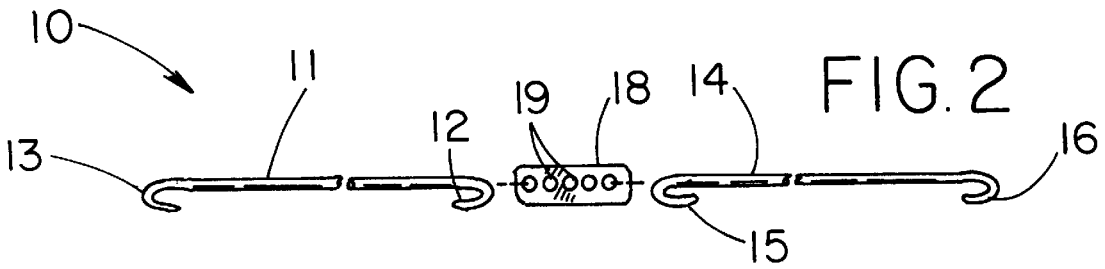
FIG. 2 is an exploded side elevational view of the present invention.
Figure 3:
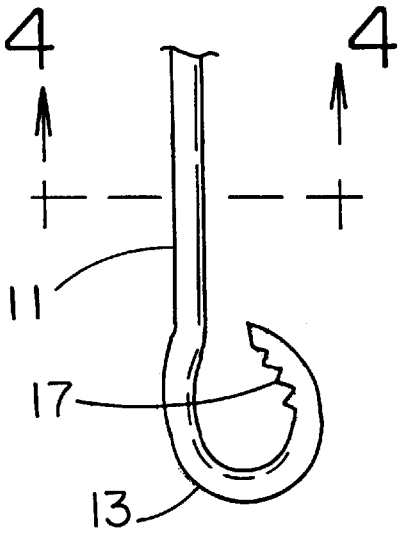
FIG. 3 is a detailed side elevational view of a hook-like end of one of the elongate members of the present invention.
Figure 4:
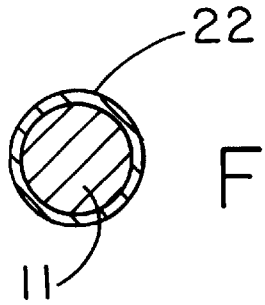
FIG. 4 is a cross-sectional view of one of the elongate members of the present invention.
Figure 5:
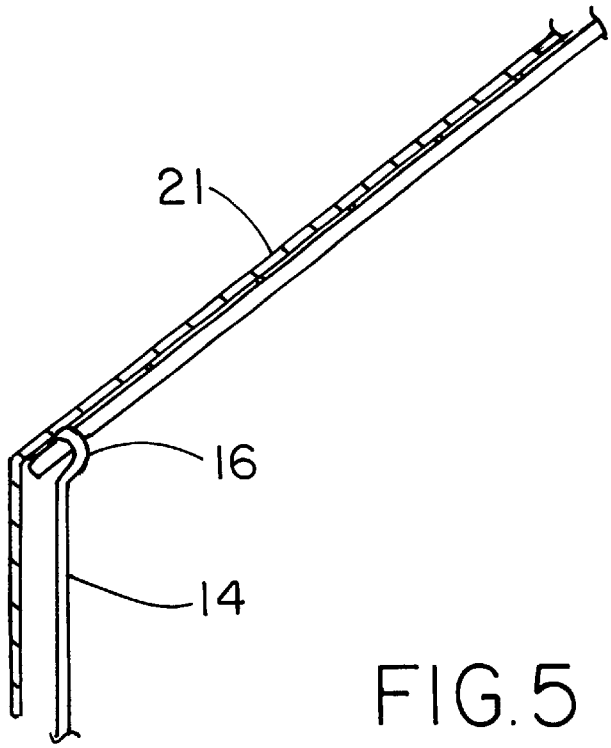
FIG. 5 is a detailed side elevational view of one of the elongate members of the present invention being connected to an outer edge of an umbrella.

With reference now to the drawings, and in particular to FIGS. 1 through 5 thereof, a new tie-downs for a table umbrella embodying the principles and concepts of the present invention and generally designated by the reference numeral 10 will be described.

As blest illustrated in FIGS. 1 through 5, the tie-downs for a table umbrella 10 generally comprises a plurality of elongate members 11,14 each of which has a first hook-like end 12,15 and a second hook-like end 13,16 and is adapted to hook to an umbrella 21 and to a table 20; and further comprises a plurality of coupling members 18 each of which includes a plurality of holes 19 spaced along a length thereof. The holes 19 are adapted to receive the hook-like ends 12,13,15,16 of the elongate members 11,14. Each of the coupling members 18 is adapted to couple together a respective pair of the elongate members 11,14 which include a first one 11 of the respective pair of the elongate members having the first hook-like end 12 being removably received in one of the holes 19 of the respective coupling member 18, and further having the second hook-like member 13 being adapted to removably attach to a table 20, and which further include a second one 14 of the respective pair of the elongate members having a first hook-like end 15 being removably received in another one of the holes 19 of the respective coupling member 18, and further having a second hook-like end 16 being adapted to removably attach to an umbrella 21. The respective pair of elongate members 11,14 and the respective coupling member 18 are adapted to interconnect the umbrella 21 to the table 20 and are adjustable with the first hook-like ends 12,15 of the respective pair of elongate members 11,14 being positionable along the length of the respective coupling member 18 with the coupling members 18 being essentially rigid wires. Each of the hook-like ends 12,13,15,16 include a plurality of teeth 17 extending along a portion thereof and being adapted to grip a portion of either the table 20 or the umbrella 21. Further, each of the coupling members 18 has a protective covering 22 conventionally attached thereabout with the protective covering 22 being essentially made of plastic. Also, each of the coupling members 18 includes a flat, rigid strip-like piece having the plurality of holes 19 spaced therealong.

In use, the user attaches the second hook-like end 16 of the second one 14 of the pair of elongate members to an outer edge of the umbrella 21, and attaches the second hook-like end 13 of the first one 11 of the pair of elongate members to an outer edge of the table 20, and then attaches the first hook-like ends 12,15 of the respective pair of elongate members 11,14 to the respective coupling member 18. The tie-downs 11,14 can be easily adjusted to the various heights of an umbrella 21 relative to the table 20 by positioning the first hook-like ends 12,15 along the coupling member 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occurm to those skilled in the art, it is not desired to limit the invention to the exact construction and operation shown and described, and accordingly, all suitable modifications and equivalents may be resorted to, falling within the scope of the invention.

We claim:

1. In combination:

a table umbrella having a central post, a plurality of ribs radiating from the central post, and a canopy resting on the ribs; and a tie-down system for securing a table umbrella comprising:

a plurality of elongate members each of which has a first hooking end and a second hooking end;

wherein a first group of said plurality of elongate members each have said first hooking end thereof being hooked on one of said ribs of said table umbrella such that said elongate members of said first group each depend from one of said ribs; and a plurality of coupling members each of which includes a plurality of holes spaced along a length thereof, the second hooking end of each of said elongate members of said first group being extended through one of said holes of one of said coupling members;

wherein a second group of said plurality of elongate members each have said first hooking end thereof being hooked on one of said holes of said coupling members such that said elongate members of said second group each depend from one of said coupling members.

2. The combination of claim 1, wherein said elongate members are rigid wires.

3. The combination of claim 1, wherein each of said coupling members includes a flat, rigid strip having said plurality of holes spaced therealong.

4. The combination of claim 1, wherein each of said hooking ends includes a plurality of teeth extending along a portion thereof and being adapted to grip a portion of either the table or the umbrella.

5. The combination of 1, wherein each of said elongate members has a protective covering thereabout.

6. The combination of claim 5, wherein said protective covering of said elongate members is essentially made of plastic.

7. In combination:

a table umbrella having a central post, a plurality of ribs radiating from the central post, and a canopy resting on the ribs; and a tie-down system for securing a table umbrella comprising:

a plurality of elongate members each of which has a first hooking end and a second hooking end;

wherein a first group of said plurality of elongate members each have said first hooking end thereof being hooked on one of said ribs of said table umbrella such that said elongate members of said first group each depend from one of said ribs; and a plurality of coupling members each of which includes a plurality of holes spaced along a length thereof, the second hooking end of each of said elongate members of said first group being extended through one of said holes of one of said coupling members;

wherein a second group of said plurality of elongate members each have said first hooking end thereof being hooked on one of said holes of said coupling members such that said elongate members of said second group each depend from one of said coupling members;

wherein each of said coupling members is adapted to couple together a respective pair of said elongate members;

wherein said elongate members include a first one of said respective pair of said elongate members having said first hooking end being removably received in one of said holes of said respective coupling member, and further having said second hooking member being adapted to removably attach to said table;

wherein said elongate members further include a second one of said respective pair of said elongate members having a first hooking end being removably received in another one of said holes of said respective coupling member, and further having a second hooking end being adapted to removably attach to said umbrella;

wherein said respective pair of elongate members and said respective coupling member are adapted to interconnect the umbrella to the table and are adjustable with the first hooking ends of said respective pair of elongate members being positionable along the length of said respective coupling member;

wherein said elongate members are rigid wires;

wherein each of said elongate members has a protective covering thereabout, said protective covering of said elongate members comprising plastic;

wherein each of said coupling members includes a flat, rigid strip having said plurality of holes spaced therealong; and wherein each of said hooking ends includes a plurality of teeth extending along a portion thereof and being adapted to grip a portion of either the table or the umbrella.

* * * * *